US005950402A

United States Patent [19]

Hoddinott

[11] Patent Number: 5,950,402

[45] Date of Patent: Sep. 14, 1999

[54] GAS ATMOSPHERE PACKAGING

[76] Inventor: Richard Grant Hoddinott, PO Box 1486, Auckland, New Zealand

[21] Appl. No.: 08/918,724

[22] Filed: Aug. 21, 1997

[30] Foreign Application Priority Data

Apr. 11, 1997 [NZ] New Zealand ..... 314588

[51] Int. Cl.[6] ..... B65B 31/02

[52] U.S. Cl. ..... 53/432; 53/400; 53/401

[58] Field of Search ..... 426/129, 132, 426/263; 53/400, 401, 402, 432, 434

[56] References Cited

U.S. PATENT DOCUMENTS

| | | | |
|---|---|---|---|
| 3,971,187 | 7/1976 | McNeill et al. | 53/434 |
| 5,299,408 | 4/1994 | Dupont | 53/432 |
| 5,398,481 | 3/1995 | Takeuchi et al. | 53/432 |
| 5,481,852 | 1/1996 | Mitchell | 53/432 |
| 5,528,880 | 6/1996 | Landolt | 53/434 |
| 5,590,509 | 1/1997 | Esteves et al. | 53/432 |
| 5,667,827 | 9/1997 | Breen et al. | 53/432 |

*Primary Examiner*—Jessica J. Harrison
*Assistant Examiner*—John Paradiso
*Attorney, Agent, or Firm*—Smith-Hill and Bedell

[57] ABSTRACT

Foamed plastic food containers are prepared for contact with food by exchanging the air in the interstices of the foam for a packaging gas prior to using the containers for packaging of food.

19 Claims, 2 Drawing Sheets

GAS ATMOSPHERE PACKAGING

BACKGROUND OF THE INVENTION

This invention concerns food packaging especially fish, meat and meat products where the colour and bacterial count of the retailed product is important.

The problem is manageable for retail markets in the same area as the supply of carcasses because the product can be offered for sale shortly after the carcass is butchered and the cuts packaged on plastic trays covered with film. But the problem is more difficult for meat packers where the product remains chilled but in transit for some days. During this period the packer usually relies on one of two techniques; vacuum packing where the meat is placed in a barrier pouch, the pouch atmosphere is evacuated in a chamber so that the pouch shrinks around the meat. Alternatively in gas flushing the meat is placed in a barrier pouch, then the pouch is evacuated on a "schnorkel" machine and carbon dioxide is inserted.

These methods are used against spoilage bacteria and to ensure retention of the acceptable colour. Even with this precaution some discoloration of the colour of the meat is possible. If this problem were removable then radical changes in the preparation of meat would be possible. Consumers and supermarkets are typically situated in cities perhaps a long distance from the rural area in which the stock are raised and fattened, for example, Montana.

This geographical arrangement means that the retail packing is carried out in the cities along with the disposal of waste which the preparation of primals generates. This practice reduces to a minimum the time taken to present the meat for sale thereby showing good colour. If the product could be transported with no loss of colour or acceptable loss of colour then it would be possible for the retail packing to be done closer to the source of the stock, namely in rural areas.

Our work has shown that the discolouration experienced by meat packers using plastic bags and carbon dioxide arises from the use of foamed polystyrene trays because the occluded air in the trays equilibrates with the carbon dioxide in the pouch and becomes available to the surface of the meat. In the instances where nonfoamed plastic trays less than 1 mm thick are used, no gas release is expected but these are more expensive and less familiar to the consumer than thicker foamed trays. Accordingly meat packers wish to retain the use of trays which are already familiar to those in the industry.

In this specification "containers" means plastic trays commonly used in the food industry which are covered with transparent film; boxes made of expanded plastic pellets and foamed plastic boxes of the type used to transport refrigerated fish and meat.

"Packaging gas" means a gas or gas mixture used in the food industry which is selected for inertness to food and for suppression of growth in food spoilage organisms. These are commonly carbon dioxide and nitrogen.

SUMMARY OF THE INVENTION

This invention provides a method of preparing foamed plastic containers for gas atmosphere packing by confinement in a gas tight storage receptacle which presents high resistance to ambient oxygen entry, in the presence of carbon dioxide before the containers are used in contact with meat, such confinement being sufficiently long for a substantial portion of the occluded air in the containers to exchange with the atmosphere in the storage receptacle then removing at least some of the atmosphere after equilibration and before the storage proper.

The invention includes a process for preparing trays for use with meat and meat products in controlled atmosphere packaging comprising subjecting the trays to a controlled atmosphere, until they receive meat and enter the gas atmosphere meat packing process. At ambient temperature trays equilibrate in about three days. Residual oxygen remains at approximately 2%.

The invention also permits the combination of the tray treating process and the known meat packaging process.

Reverting to the tray treatment conveniently the exposure may take place when the trays wait in a warehouse, stockroom or the like, stacked inside plastic bags in which they are delivered. The plastic bags may be inside cartons. The cartons may be presented to a carbon dioxide injection machine.

Such machines are standard in the meat packing industry. The packing process includes initial evacuation to remove air which contracts the plastic bag around the stacks of trays. Thereafter the bag is reinflated with carbon dioxide.

The evacuation stage is optional if solid carbon dioxide is added in the appropriate quantity and allowed to form a heavier layer of gaseous carbon dioxide upon which the air floats and leaves the bag through a one way valve. In use meat packers take delivery of trays in this way and the preservation of the carbon dioxide content persists during the entire period of transit. Preferably exposure of the trays to air is limited as far as is practicable at the point of use. The trays are left in the carton as late as possible and once opened are used quickly. Any trays which are exposed overnight are first used the following morning. The tray is loaded with meat, film wrapped and placed in a pouch with other trays. Carbon dioxide is injected and the pouch sealed up.

The process works satisfactorily without the evacuation stage. This is a useful variant where volumes larger than a cubic meter carton are utilised, for example a small conditioning room. Here the trays are placed in bags as usual and dry ice is metered into the bags. The air in the bags equilibrates as before. Fresh dry ice is added on the second and third days and at the end of the third day equilibration is substantial complete and the trays are ready to be freighted or used.

BRIEF DESCRIPTION OF THE DRAWINGS

One embodiment of the invention is now described with reference to the accompanying drawings in which.

DETAILED DESCRIPTION OF THE INVENTION

Figure 1:
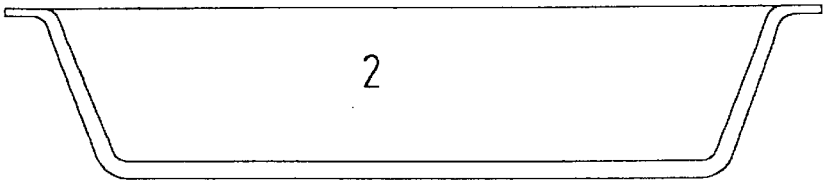
FIG. 1 is a section of a meat tray.

Referring now to FIG. 1 the tray 2 is made of 2.0 mm thickness foamed polystyrene. The plastic bag 8 is a gas barrier bag namely a polyethylene EVOH coextrusion, folded and sealed to create a self opening satchel with a flat bottom 6 and M-section gussets which readily opens to a rectangular columnar bag fitting closely inside a carton 10.

Figure 2:
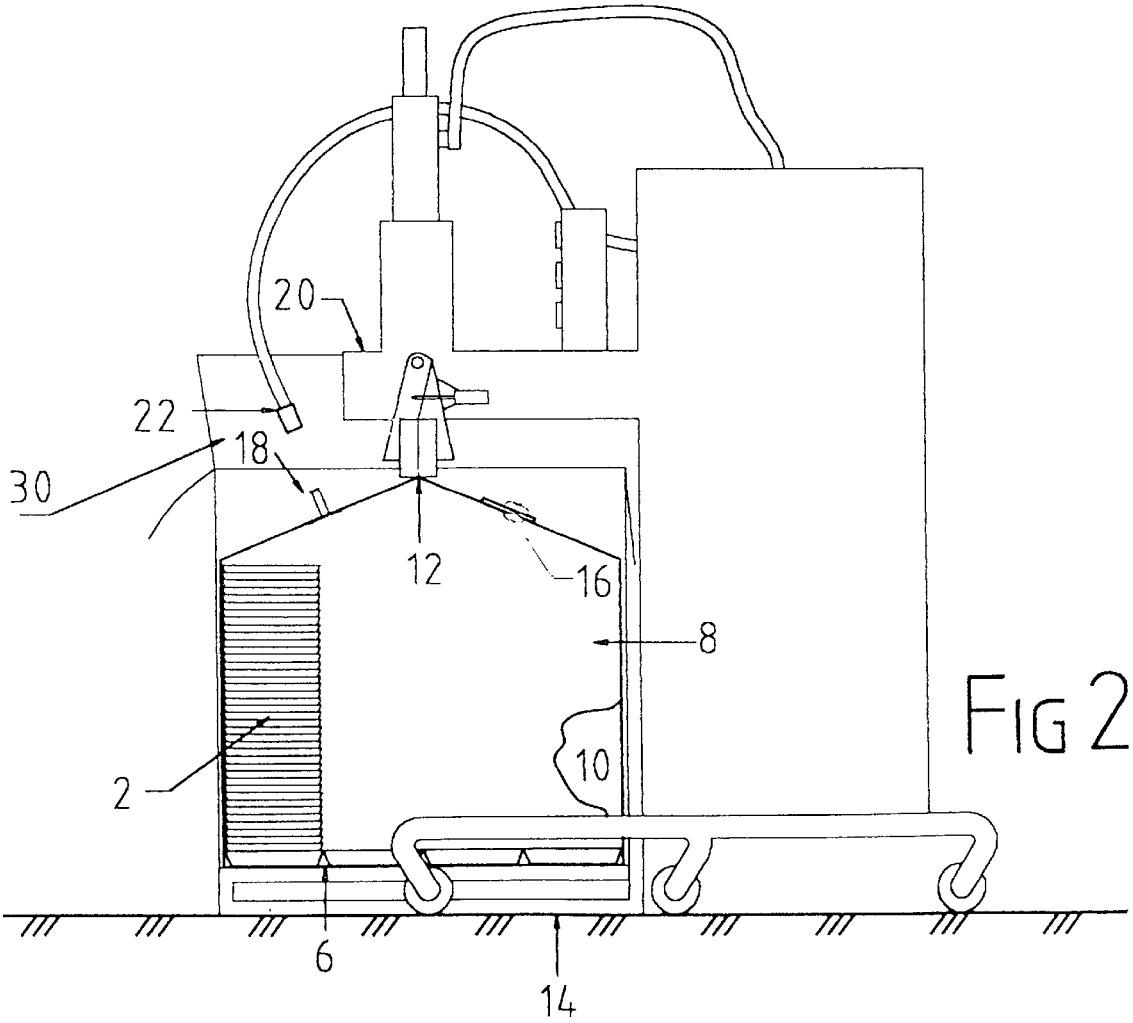
FIG. 2 is a side view of a gas atmosphere packaging machine treating a sectioned carton standing on a pallet containing stacked trays as shown in FIG. 1 inside a plastic satchel.

In FIG. 2 the trays 2 sit inside a thousand liter bag in orderly stacks. Typically 2 kg of dry ice is dropped in with the trays when a bag is full. The bag is closed by a single horizontal edge to edge seam 12. The carton sits on pallet 14. The top of the bag has a one way outlet valve 16 and a self sealing inlet or charging valve 18. Outlet valve 16 is a valve which opens under a few mm pressure. The charging valve 18 has a flange welded to the bag and has a tire type valve core enabling the bag to be charged by an operative visiting open boxes with a gas cylinder and inflator hose 3–4 days after the initial charging.

The coextruded bag film presents an efficient barrier to oxygen. The trays which contain occluded carbon dioxide occupy much of the space in the bag. The bag lies within the carton. The carton is kept open and the head 20 of a CORR-VAC (RTM) gas flushing machine is wheeled next to the carton 10. The head height is adjusted to bring the sealing bars to the appropriate height. A nozzle 22 registers with charging valve 18.

The machine evacuates the bag. We prefer to reduce pressure to 5 millibars in order to leave very little air in the bag before reinflating with carbon dioxide and sealing the bag. Over time the carbon dioxide atmosphere inside the bag will equilibrate with the atmosphere within the trays. The vapour density of oxygen causes it to float on the carbon dioxide and under the pressure produced from the carbon dioxide produced from the subliming dry ice, the oxygen is released through the outlet valve.

Figure 3:
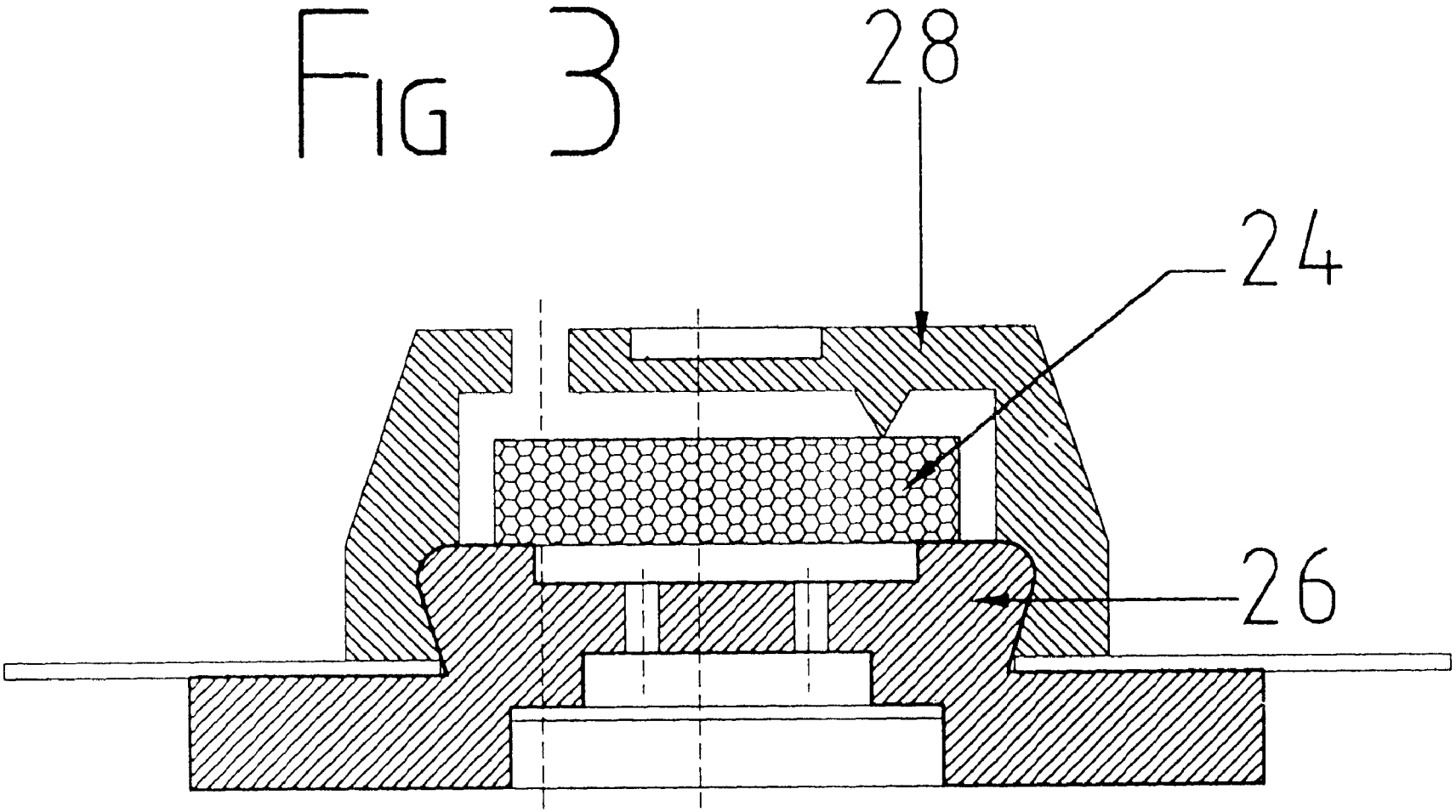
FIG. 3 is a section through a known one way valve suitable for releasing gas from the satchel.

Excess gas leaves through the outlet valve 16. In FIG. 3 the valve flange is welded to the bag wall close to the top seam. A rubber diaphragm 24 lifts from circular seat 26 allowing gas to pass through cap 28 to the exterior. Such valves are obtainable from Luigi Goglio—Milan S p A.

If the cartons are to remain as stock the carton flaps 30 remain open so that replenishment by injections of carbon dioxide can be made. As the occluded carbon dioxide equilibrates with the atmosphere in the bag, little change occurs. Any air which has been taken up by exchange is disposed of as follows. Since the vapour density of oxygen is less than that of a carbon dioxide, the oxygen floats on the carbon dioxide. As the outflow valve 16 is at the top of the bag the injection of fresh carbon dioxide increases the pressure which opens the outflow valve and releases the normal atmosphere.

In the packing department the cartons arrive substantially air free. The packer removes the trays from the carton. The trays are filled with meat, film wrapped and a group are put in a pouch. The pouch undergoes evacuation in known manner, then carbon dioxide injection. It remains inside the taped carton in transit for the supermarket. We have found the advantages of the process to be:

1 Carcasses can be cut into retail presentations at the abattoir rather than in the supermarket's meat department;

2 Meat is less subject to discoloration;

3 Less meat becomes unsaleable due to poor colour;

4 Aerobic bacterial counts are stabilised.

I claim:

1. A process for preparing foamed plastic food containers for contact with food, which food is adversely affected by air contact, comprising exchanging the air in the interstices of the foam for a packaging gas prior to using the containers for packaging of food.

2. A process as claimed in claim 1 wherein the packaging gas is carbon dioxide or nitrogen.

3. A process for preparing foamed plastic food trays for gas atmosphere packaging by confinement in a gas tight storage receptacle which presents high resistance to ambient oxygen entry, with a packaging gas before the bags hold food, such confinement being sufficiently long for a substantial percentage of the air in the foam to exchange with the gas in the storage container.

4. A process as claimed in claim 3 wherein the packaging gas is carbon dioxide or nitrogen.

5. A process of preparing plastic foam trays for use with meat and other fresh protein foods comprising, before placing the trays in contact with food, subjecting the trays to a packaging gas atmosphere in order to exchange interstitial air in the plastic foam for the packaging gas until substantial exchange with the interstitial air occurs.

6. A process as claimed in claim 3 comprising placing the trays in a gas tight storage receptacle and establishing the packaging gas atmosphere in the gas tight storage receptacle, and wherein the containers stay in the packaging gas atmosphere until the gas tight storage receptacle is unpacked for the reception of food and inclusion in a gas atmosphere packaging operation.

7. A process as claimed in claim 6 wherein the gas tight storage receptacle is a plastic bag.

8. A process as claimed in claim 6 wherein the storage receptacle holding the trays is partially evacuated to remove air, then charged with a packaging gas and sealed.

9. A process as claimed in claim 8 wherein a quantity of solid carbon dioxide is added to the storage receptacle prior to charging and prior to sealing.

10. A process as claimed in claim 8 wherein the evacuation proceeds to 2–5 millibars.

11. A process as claimed in claim 9 wherein the quantity solid carbon dioxide is 1.0–2.5 kg/1000 liter volume of the storage receptacle.

12. A process as claimed in 9 wherein the storage receptacle is vented whereby the air in the air/packaging gas mixture is able to leave the receptacle under the subliming vapour pressure of the carbon dioxide but air is prevented from re-entry.

13. A process as claimed in claim in claim 9 wherein the storage receptacle enclosing the containers has a port for replenishing the storage receptacle with packaging gas.

14. A process as claimed in claim 13 wherein the port is a self sealing port.

15. A process as claimed in claim 6 comprising replenishing the gas tight storage receptacle with packaging gas after 6–10 days.

16. A process as claimed in claim 5 wherein the packaging gas is carbon dioxide or nitrogen.

17. A process as claimed in claim 5 comprising placing the containers in a gas tight storage receptacle and filling the receptacle with a packaging gas.

18. A process for preparing plastic foam containers for use with food, wherein there is air in the foam, which air tends to adversely affect the food, comprising, prior to using the containers for packaging of food, exchanging the air in the foam for a packaging gas, in combination with a conventional gas atmosphere packaging process.

19. A process as claimed in claim 18 wherein the packaging gas is carbon dioxide or nitrogen.

* * * * *